US007877964B2

(12) United States Patent
Spinks et al.

(10) Patent No.: US 7,877,964 B2
(45) Date of Patent: Feb. 1, 2011

(54) POCKETED SPRING UNITS

(75) Inventors: Simon Paul Spinks, Cawood (GB); David Clare, Barnsley (GB)

(73) Assignee: A Harrison (Bedding) Limited, Leeds, West Yorkshire (GB)

( * ) Notice: Subject to any disclaimer, the term of this patent is extended or adjusted under 35 U.S.C. 154(b) by 302 days.

(21) Appl. No.: 11/992,147

(22) PCT Filed: Sep. 15, 2006

(86) PCT No.: PCT/GB2006/003439

§ 371 (c)(1),
(2), (4) Date: Mar. 17, 2008

(87) PCT Pub. No.: WO2007/031774

PCT Pub. Date: Mar. 22, 2007

(65) Prior Publication Data

US 2009/0266032 A1 Oct. 29, 2009

(30) Foreign Application Priority Data

Sep. 17, 2005 (GB) ..... 0519009.5

(51) Int. Cl.
*B65B 63/02* (2006.01)
*B68G 9/00* (2006.01)

(52) U.S. Cl. ..... 53/438; 53/114; 53/529

(58) Field of Classification Search ..... 53/438, 53/50, 114, 428, 529; 29/91.1, 896.92
See application file for complete search history.

(56) References Cited

U.S. PATENT DOCUMENTS 1,915,264 A * 6/1933 Schneider et al. ..... 53/114
1,950,186 A * 3/1934 Lofman ..... 53/114
3,429,767 A * 2/1969 Bronstien, Jr. et al. ..... 156/165
3,449,190 A * 6/1969 Bronstien, Jr. et al. ..... 156/250
3,462,779 A * 8/1969 Thompson ..... 5/655.8
3,668,816 A * 6/1972 Thompson ..... 53/418
4,491,491 A * 1/1985 Stumpf ..... 156/73.3
4,986,518 A * 1/1991 Stumpf ..... 267/91
5,444,905 A * 8/1995 St. Clair ..... 29/564.7
5,572,853 A * 11/1996 St. Clair et al. ..... 53/440
6,021,627 A * 2/2000 Mossbeck et al. ..... 53/438
6,101,697 A * 8/2000 Stumpf et al. ..... 29/91
6,159,319 A * 12/2000 Mossbeck ..... 156/182
6,260,331 B1 * 7/2001 Stumpf ..... 53/436

(Continued)

FOREIGN PATENT DOCUMENTS

EP 1067090 A1 * 1/2001

*Primary Examiner*—Thanh K Truong
(74) *Attorney, Agent, or Firm*—Klauber & Jackson, LLC

(57) ABSTRACT

A method and apparatus for the production of a pocketed spring unit, the method comprising the steps of compressing and feeding a plurality of springs (42) into troughs (2A, 4A) or castellations in opposed conveyor belts (2, 4), moving said springs (42) from said troughs (2A, 4A) or castellations to a position between upper and lower layers of fabric or other material (16A, 18A), step-wise advancing said material (16A, 18A) and said springs (42) in the direction of the output of the apparatus and welding together said lengths of fabric or other material (16A, 18A) at each step-wise advancement by a plurality of sequentially controlled welding anvils (10) so as to form a plurality of discrete pockets (46) each containing a spring (42). Apparatus for carrying out the method is disclosed.

7 Claims, 4 Drawing Sheets

U.S. PATENT DOCUMENTS 6,574,811 B1 * 6/2003 Mossbeck ..... 5/655.8
6,698,166 B2 * 3/2004 Zysman ..... 53/550
6,834,477 B2 * 12/2004 De Santis et al. ..... 53/436
6,922,895 B1 * 8/2005 Whitworth ..... 29/896.92
2002/0124321 A1 * 9/2002 Wells ..... 5/720

* cited by examiner

POCKETED SPRING UNITS

CROSS REFERENCE TO RELATED APPLICATIONS

The present application is a National Stage Application claiming the priority of co-pending PCT Application No. PCT/GB2006/003439 filed Sep. 15, 2006, which in turn, claims priority from Great Britain Application Serial No. 0519009.5, filed Sep. 17, 2005. Applicants claim the benefits of 35 U.S.C. §120 as to the PCT application and priority under 35 U.S.C. §119 as to the said Australian application, and the entire disclosures of both applications are incorporated herein by reference in their entireties.

This invention relates to pocketed spring units, and to a method and apparatus for forming such units.

There have been many prior proposals for forming pocketed spring units, but it is felt that such prior proposals have been overly complicated and costly to produce, and the present invention seeks to obviate these and other disadvantages of such prior proposals.

According to one aspect of the present invention, there is provided a method for the production of a pocketed spring unit comprising the steps of compressing and feeding a plurality of springs into troughs or castellations in opposed conveyor belts, moving said springs from said troughs or castellations to a position between upper and lower layers of fabric or other material, step-wise advancing said material and said springs in the direction of the output of the apparatus and welding together said lengths of fabric at each said step-wise advancement by a plurality of sequentially controlled welding anvils so as to form a plurality of discrete pockets each containing a spring.

The method may include the additional step of forming the springs immediately prior to the springs being compressed and fed into said troughs or castellations.

According to another aspect of the present invention, there is provided apparatus for forming a pocketed spring unit comprising means for compressing and feeding springs between opposed conveyor belts, means for moving said compressed springs from between said conveyor belts in the direction of the output of the apparatus to positions between upper and lower lengths of fabric or other material, means for sequentially advancing said lengths and said springs in said direction, and welding means for sequentially welding together said lengths so as to form a plurality of discrete pockets each containing a spring.

Preferably, said springs will be fed to the positions between the opposed conveyor belts by means of an inserter mechanism, operation of said mechanism simultaneously compressing said springs.

The opposed conveyor belts will each consist of an endless castellated or troughed belt, and the means to feed the compressed springs from between the conveyor belts to positions between said lengths of fabric or other material will preferably be power-driven spring inserters having a plurality of arms adapted to enter and leave the castellations or troughs in said belts, said arms being greater in overall height than the height of the springs and making contact with said springs to move said springs between said layers.

The welding means will preferably be a plurality of movable welding anvils and a plurality of co-operating welding horns, said welding means being adapted to sequentially weld said layers together at each sequential movement of said layers and springs so as to form said discrete pockets.

The apparatus may include a spring coiler as an integral part of the apparatus, such coiler delivering the formed springs directly to the spring compressor and feeder means.

In order that the invention may be more readily understood, an embodiment thereof will now be described, by way of example only, reference being made to the accompanying drawings, wherein.

Figure 1:
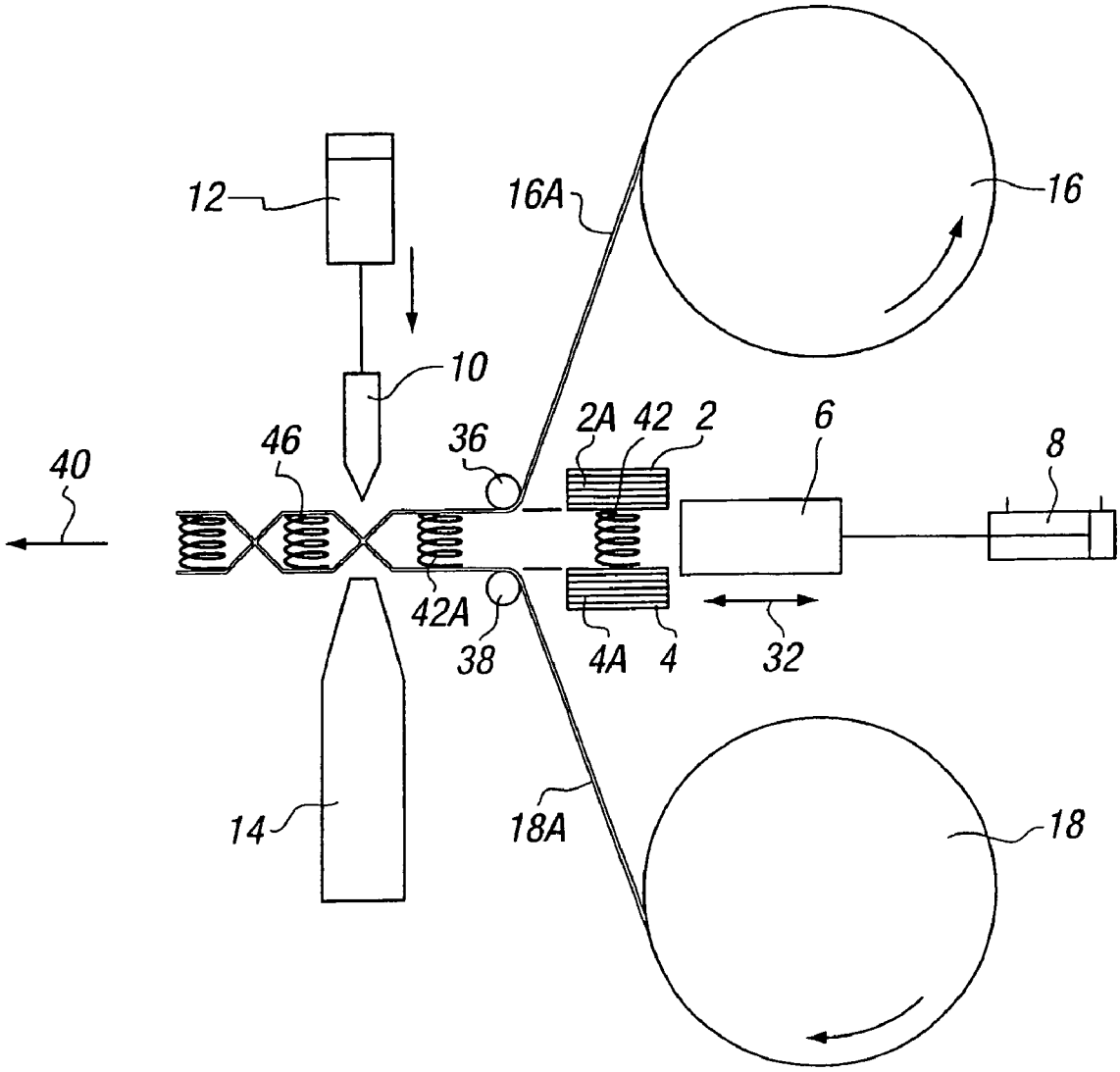
FIG. 1 is a schematic side view of apparatus in accordance with the invention.
Figure 2B:
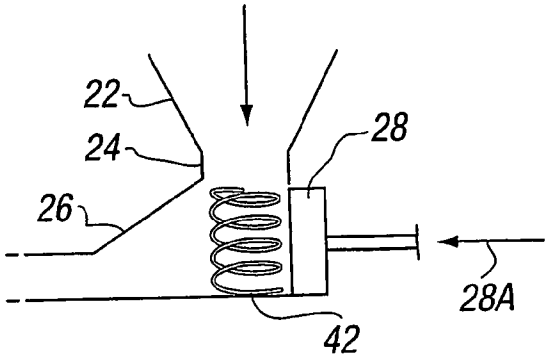
FIGS. 2A to 2D are schematic representations of a part of the apparatus of FIG. 1, and showing its sequence of operations.
Figure 2C:
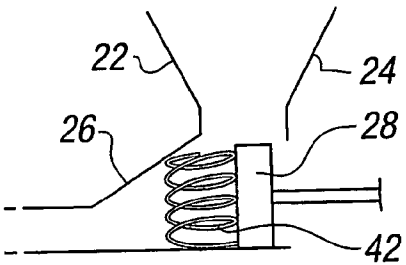
Figure 2D:
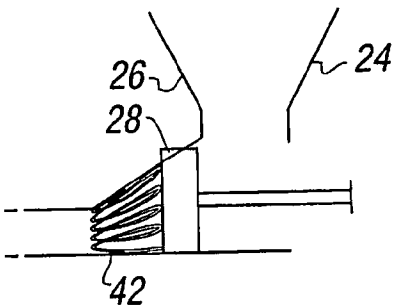
Figure 2A:
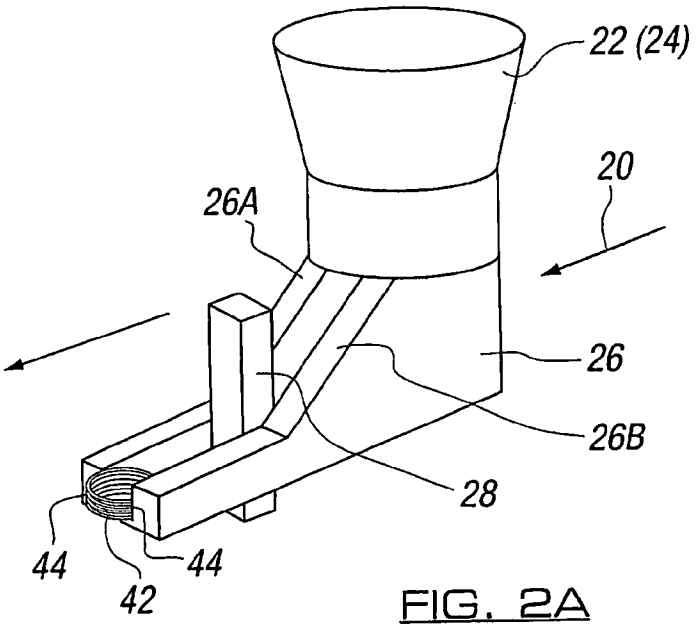

Referring to the drawings and firstly to FIG. 1, the apparatus for forming a spring unit comprises a spring compression and feeder, not shown in FIG. 1, but referenced 20 in FIG. 2A, spring delivery belts 2 and 4, spring inserters 6 and associated cylinders 8, a plurality of welding anvils, a plurality of air cylinders, and a plurality of welder horns, one each of these items being respectively referenced 10, 12, and 14. Rolls 16 and 18 of fabric or other material are shown associated with the apparatus.

Referring now to FIGS. 2A to 2D, the spring compressor 20 comprises a frusto-conical upper section 22, a straight-sided mid-section 24, and a forwardly-sloping bifurcated lower section 26. Associated with the compressor 20 is a power-operated, preferably compressed air-operated, pusher and ejector plate 28.

Figure 3:
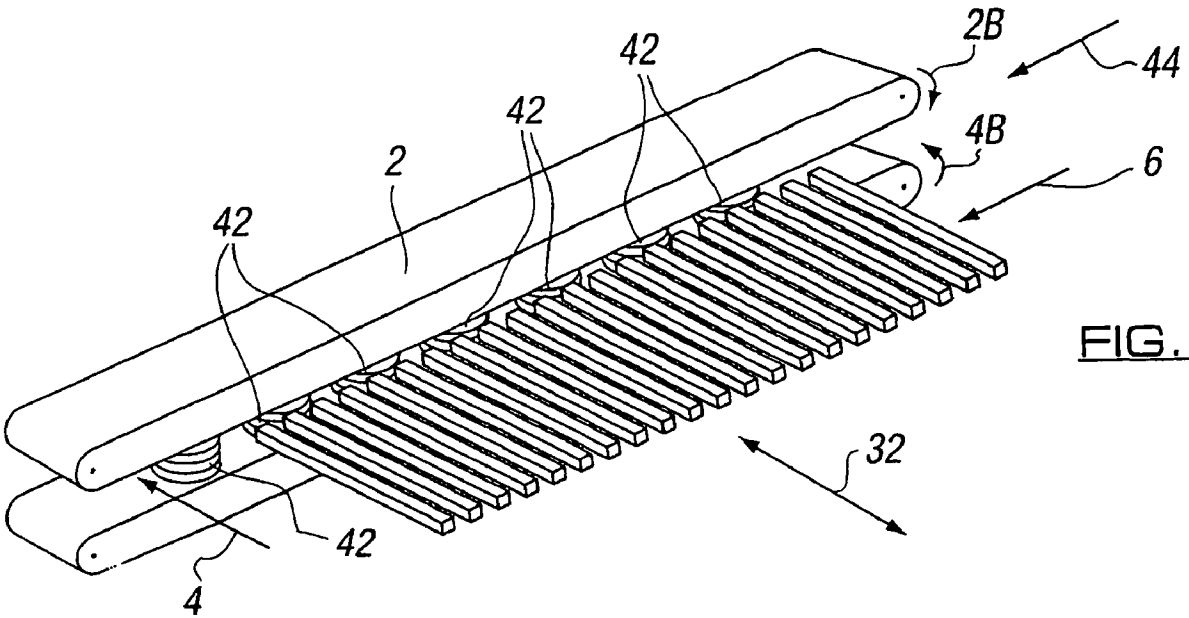
FIG. 3 is an enlarged perspective view of another part of the apparatus of FIG. 1.
Figure 4:
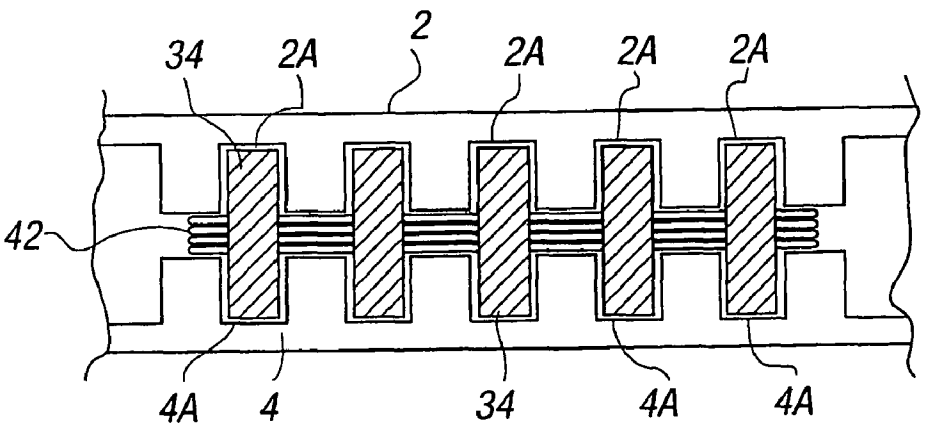
FIG. 4 is an enlarged view of a part of FIG. 3.

FIGS. 3 and 4 show the spring delivery belts 2 and 4, and the spring inserter 6 in detail. Each delivery belt 2 and 4 is endless and is castellated or troughed as indicated at 2A and 4A respectively. Each of the delivery belts is indexable so as to be movable in the direction of arrows 2B and 4B and is composed of any suitable material, but preferably a plastics material, and one or both of the delivery belts will be positively driven. The delivery belts 2 and 4 are journalled in suitable frame members, not shown in the drawings.

Associated with the spring delivery belts 2 and 4 is the spring inserter 6 which is movable in the direction of arrows 30 and 32 by the air cylinders 8. The spring inserter 6 consists of a plurality of inserter arms 34 which are mounted on a suitable framework (not shown) which in turn is connected to the air cylinders 8 so as to enable said framework, and hence the inserter arms, to be moved in the directions of the arrows 30 and 32. There will preferably be a plurality of horizontally in-line spring inserters 6, each having a plurality of inserter arms 34, and in a preferred embodiment of the invention, there will be two inserters 6 each having three inserter arms 34, each inserter 6 being movable by an air cylinder 8. These spring inserters 6 will preferably be linked so as to move in unison.

As clearly shown in FIG. 4, the inserter arms 34 of the spring inserters 6 will be of a depth and width such that they can pass into and out of the castellations or troughs 2A and 4A of the spring delivery belts 2 and 4 so as to enable the compressed springs to be fed between the layers of fabric or other material being fed from the rolls 16 and 18 as will be hereinafter explained.

Figure 5:
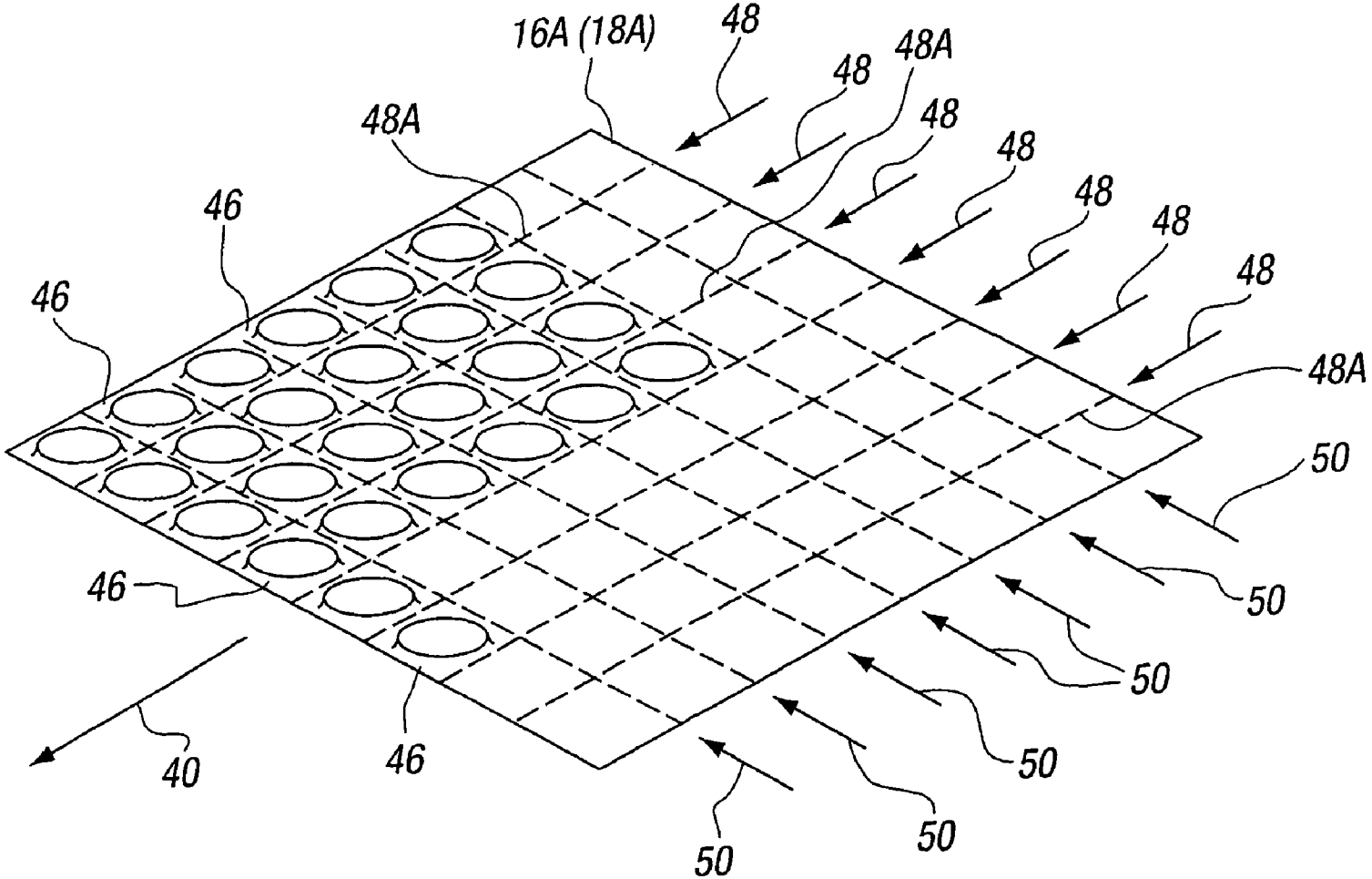
FIG. 5 is a schematic perspective view of a spring unit formed on the apparatus of FIG. 1.

The welding anvils 10 and their associated air cylinders 12 are operable, in conjunction with the welder horns 14, to work in a predetermined and pre-programmed manner so as to form a required pattern (as shown in FIG. 5) and entrap individual springs between the layers 16A and 18A of fabric or other material fed from the rolls 16 and 18. This will be explained in greater detail below.

Associated with the above-described apparatus is a spring coiler (not shown) which is adapted to form individual springs for delivery to the spring compressor 20. Such coiler may be an integral part of the apparatus previously described, or alternatively the springs may be pre-formed and delivered individually by suitable means to the spring compressor.

In operation, fabric or other material 16A and 18A is fed from the rolls 16 and 18 and passes around guide rollers 36 and 38 and continues to move in the direction of arrow 40, FIG. 1. As fabric or other material 16A and 18A continues to be fed from the rolls 16 and 18, individual springs 42 are located in the spring compressor and feeder 20 and contacted by the plate 28 which, moving in the direction of arrow 28A, moves the spring 42 towards and against the sloping section 26 so as to compress the spring axially as shown in FIG. 2D. Continued movement of the plate 28 between the bifurcations 26A and 26B moves the compressed spring into a slot 44 at the end of the spring compressor and feeder 20 and thence between the belts 2 and 4 at the proximal extremities thereof The compressed spring 42 is moved by and between the belts 2 ands 4 in the direction of arrow 44 (FIG. 3) towards the distal extremities of the belts. When a predetermined number of springs 42 are located in-line between the belts 2 and 4, the air cylinders 8 are actuated such that the spring inserters 6 move towards the belts and such that the inserter arms 34 move into the castellations or troughs 2A and 4A in the belts, resulting in the springs 42 passing between the rollers 36 and 38 to the positions 42A between the fabric or other material 16A and 18A.

When the row of springs 42 are at the position indicated by reference numeral 42A, the air cylinders 12 and hence the welding anvils 10 are actuated so as to entrap the springs in discrete pockets across the width of the fabric or other material, one of such pockets being indicated by reference numeral 46 in FIG. 1.

In the formation of the discrete pockets, during which the springs are still in their compressed states, the multiple air cylinders control individual welding anvils to produce a grid pattern of welds which join the lengths of fabric or other material together, the welding anvils working in cooperation with the plurality of welder horns 14.

Reference to FIG. 5 will show the pattern of welds to form the discrete pockets 46. Each of the longitudinal welding lines indicated by reference numeral 48 is formed by a step movement of the lengths 16A and 18A of fabric or other material in the direction of the arrow 40 followed by a step welding process, selected welding anvils 10 being actuated every segment length 48A of the welding lines 48. In the described embodiment of the invention, each segment length is 16 mm, but it will be appreciated that such length may be changed Each of the lateral welding lines 50 is produced by the step movement of the lengths 16A and 18A to the required positions followed by the actuation of all welding anvils, such actuation—in the embodiment of the invention being described—being every 75 mm, it again being appreciated that such distance may be changed.

Electronic control devices, not shown in the drawings, control the step movement of the lengths 16A and 18A of fabric or other material.

In addition, electronic control devices (not shown) control the compression and feeding of the springs between the conveyor belts 2 and 4, and the movement of the spring inserters 6 such that all the sequences of the apparatus is precisely controlled.

It will be appreciated that the spring compressor and feeder may differ from that shown in the drawings, and that the welding pattern may differ to that described. The chosen welding pattern, as regards its form and length of segments will be variable at will, and to some extent may well be determined by the type and nature of the springs being entrapped.

Thus the invention provides a method and apparatus for forming a pocketed spring unit for incorporation into an upholstered unit, the length and width of the pocketed spring unit being unlimited Finally, it will be appreciated that many variations may be made to the apparatus of the invention without departing from the spirit thereof and it is intended that any such variations are encompassed herein.

The invention claimed is:

1. A method for the production of a pocketed spring unit comprising the steps of compressing and feeding a plurality of springs into troughs or castellations in opposed conveyor belts, moving said springs from said troughs or castellations to a position between upper and lower layers of fabric or other material step-wise advancing said material and said springs in the direction of the output of the apparatus and welding together said lengths of fabric or other material at each step-wise advancement by a plurality of sequentially controlled welding anvils so as to form a plurality of discrete pockets each containing a spring, wherein said springs are fed to the positions between the opposed conveyor belts by means of an inserter mechanism, operation of said mechanism simultaneously compressing said springs, and wherein the means to feed the compressed springs between said lengths of fabric or other material are power-driven spring inserters each having a plurality of arms adapted to enter and leave the castellations or troughs in said belts, said arms being greater in overall height than the height of the springs when the springs are between the belts and making contact with said springs to move said springs between said layers of fabric or other material.

2. A method according to claim 1, including the step of forming the springs immediately prior to the springs being compressed and fed into said troughs or castellations.

3. Apparatus for forming a pocketed spring unit comprising means for compressing and feeding springs between opposed conveyor belts, means for moving said compressed springs from between said conveyor belts in the direction of the output of the apparatus to positions between upper and lower lengths of fabric or other material, means for sequentially advancing said lengths and said springs in said direction, and welding means for sequentially welding together said lengths so as to form a plurality of discrete pockets each containing a spring, wherein said springs are fed to the positions between the opposed conveyor belts by means of an inserter mechanism, operation of said mechanism simultaneously compressing said springs, and wherein the means to feed the compressed springs between said lengths of fabric or other material are power-driven spring inserters each having a plurality of arms adapted to enter and leave castellations or troughs in said belts, said arms being greater in overall height than the height of the springs when the springs are between the belts and making contact with said springs to move said springs between said layers of fabric or other material.

4. Apparatus according to claim 3, wherein the opposed conveyor belts each consist of an endless castellated or troughed belt, each belt being indexable, and one at least of said belts being positively drawn.

5. Apparatus according to claim 3, wherein said welding means is a plurality of movable welding anvils and a plurality of co-operating welding horns, said welding means being adapted to sequentially weld said layers together at each sequential movement of said layers and said springs so as to form said discrete pockets.

6. Apparatus according to claim 5, wherein the welding anvils are movable by associated air cylinders and are operable, in conjunction with the welding horns, to work in a predetermined and preprogrammed manner so as to form a required pattern and entrap individual springs between the layers of fabric or other material.

7. Apparatus according to claim 3, including a spring coiler adapted to form individual springs for delivery to said means for compressing and feeding springs.

* * * * *